US006009989A

United States Patent [19]

Boffelli et al.

[11] Patent Number: 6,009,989

[45] Date of Patent: Jan. 4, 2000

[54] COUPLING FOR ROTATIONALLY CONNECTING TOGETHER THE DRIVE SHAFTS OF WEAVE MACHINES AND WEAVING LOOMS

[75] Inventors: Piercarlo Boffelli, Milan; Erminio Depoli, Crema, both of Italy

[73] Assignee: Baruffaldi S.P.A., Milan, Italy

[21] Appl. No.: 09/067,514

[22] Filed: Apr. 28, 1998

[30] Foreign Application Priority Data

May 6, 1997 [IT] Italy ..... MI97A1046

[51] Int. Cl.[7] ..... D03D 51/00; F16D 27/118

[52] U.S. Cl. ..... 192/90; 192/69.8

[58] Field of Search ..... 192/48.2, 69.8, 192/69.9, 84.92, 84.961, 85 CA, 90, 91 A; 139/1 E; 74/665 B, 665 E

[56] References Cited

U.S. PATENT DOCUMENTS

| | | | |
|---|---|---|---|
| 1,913,046 | 6/1933 | Callan | 192/69.8 |
| 2,906,383 | 9/1959 | Gariel | 192/69.9 X |
| 4,572,343 | 2/1986 | Boffelli | 192/48.2 X |
| 4,592,392 | 6/1986 | Vandeweghe et al. | 139/1 E |
| 4,875,565 | 10/1989 | Depoli | 192/48.2 |
| 5,313,988 | 5/1994 | Bilcke et al. | 139/1 E |

FOREIGN PATENT DOCUMENTS

| | | | |
|---|---|---|---|
| 905315 | 2/1987 | Belgium . | |
| 0 161 012 | 11/1985 | European Pat. Off. . | |
| 0 322 928 | 7/1989 | European Pat. Off. . | |
| 3229192 | 2/1984 | Germany | 192/90 |

*Primary Examiner*—Richard M. Lorence
*Attorney, Agent, or Firm*—Herbert Dubno

[57] ABSTRACT

A loom coupling has a loom shaft with a disk having teeth on its face engageable with a toothed wheel mounted on a machine shaft. An annular electromagnet on a support surrounding the end of the loom shaft is juxtaposed directly with the disk and axially effective springs on the end of the loom shaft resistant displacement of the disk so that the disk can be brought directly into contact with the electromagnet against the force of the springs when the electromagnet is energized.

6 Claims, 2 Drawing Sheets

COUPLING FOR ROTATIONALLY CONNECTING TOGETHER THE DRIVE SHAFTS OF WEAVE MACHINES AND WEAVING LOOMS

FIELD OF THE INVENTION

The present invention relates to a coupling for rotationally connecting together the drive shafts of weaving machines and weaving looms.

BACKGROUND OF THE INVENTION

It is known in the art relating to the operation of weaving looms that such looms must be provided with components for conveying the weft yarns and components for moving the yarns forming the warp.

The components for conveying the weft yarns may be of different types, including those of the so-called gripper type and those of the air type, depending on whether the yarn is conveyed by mechanical components, known as grippers, or by directional jets of compressed air.

The components for moving the warp yarns are instead called weave machines and may be of the Jacquard or dobby type. These machines, particularly in the case of gripper looms, must be able to be operated in synchronism with the components conveying the weft yarns, so as to form the planned fabric design.

It is also known that, during weaving, breakage of the weft yarn may occur and in such cases, in order to avoid having a defect in the finished piece of cloth, it is necessary to interrupt weaving and, while keeping the components conveying the weft yarn at a standstill, to cause backward movement of the weave machine, undoing the fabric which has formed from the time the loom has stopped, in order to restore the continuity of the interrupted weft yarn.

While in the case of an air loom, the latter operation may be relatively simple, in the case of gripper looms it is necessary to separate the dobby from the loom and perform the backward movement thereof into the required position using an auxiliary low-speed drive.

In order to start again the weaving process it is therefore necessary to restore the coupled condition between loom and dobby, bringing them back into the relative angular position present at the time of their separation, so as to ensure the same synchronism between the relative movements occurring at the time of the interruption.

For this purpose, EP 0,322,928 discloses, for example, dual-clutch electromagnetic couplings which allow the loom to be coupled with the dobby via the first clutch, or the two of them to be separated so as to connect, via the second clutch, the dobby to an auxiliary drive by means of which an independent movement of the dobby is possible.

These dual-clutch couplings, however, have considerable dimensions and weight, particularly on account of the rotor element of the clutch integral with the shaft of the weaving loom, which element must interact with the respective electromagnet in order to produce the magnetic flux field designed to recall, in the axial direction, the clutch element which is coupled with a corresponding element of the dobby clutch.

Said rotor, although being axially fixed, requires large dimensions in order to avoid air-gap interference between rotor and electromagnet-carrying body fixed to the machine, with an increase in the costs of production and assembly of the coupling.

OBJECTS OF THE INVENTION

It is an object of the invention to provide a coupling for weaving looms which overcomes these problems and allows moreover any transmission means to be used between an auxiliary motor used for slow running of the weave machine and the gearing which can be coupled to the driven shaft of said machine, in particular transmissions with cylindrical, conical, helical and similar gearings, hydraulic transmissions and the like, depending on requirements.

Another object is to provide a coupling having a small number of parts which can be easily assembled, so as to result in lower cost and reduced maintenance.

SUMMARY OF THE INVENTION

These objects are attained in accordance with the present invention by a coupling for connecting together the drive shafts of weave machines and weaving looms, comprising at least one clutch element integral with the the shaft of the weave machine and a clutch integral with the shaft of the weaving loom, wherein the clutch comprises a disc movable coaxially, as a result of the thrusting action of associated means, for engagement with said clutch element integral with the shaft of the weave machine, there also being provided means for restoring the disc in the axial direction so as to cause disengagement of the clutch element integral with the shaft of the weave machine.

BRIEF DESCRIPTION OF THE DRAWING

The above and other objects, features, and advantages will become more readily apparent from the following description, reference being made to the accompanying drawing in which:

FIG. 6 shows an embodiment of the means for synchronization of the drive shaft and driven shaft.

SPECIFIC DESCRIPTION

Figure 2:
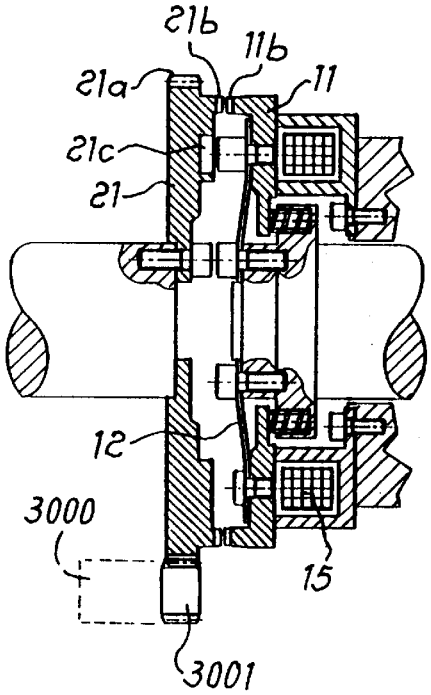
FIG. 2 shows the coupling of FIG. 1 in the condition where it is disengaged from the shaft of the weave machine for slow running controlled by an auxiliary component.
Figure 3:
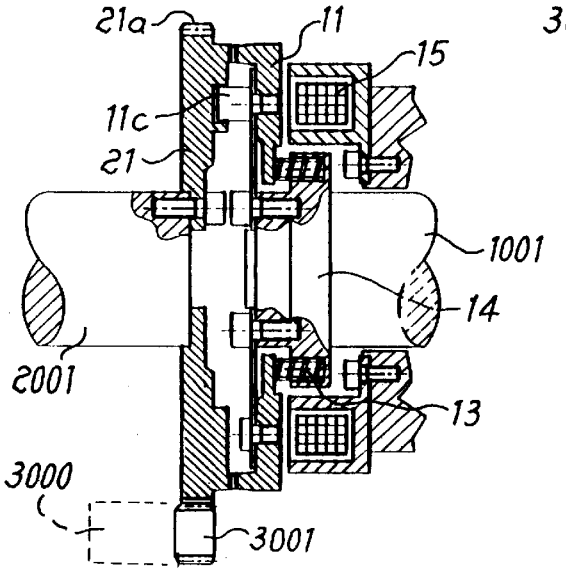
FIG. 3 shows the clutch according to FIG. 1 in the condition where it is engaged with the shaft of the weave machine for operation of both shafts with slow running by means of an auxiliary component.

As illustrated (FIGS. 1, 2, 3) the coupling according to the invention is applied to weaving machinery schematically shown with a gripper-type loom section 1000 and a weave machine section 2000 (identified below for the sake of simplicity as a dobby) which have, emerging from them, a respective drive shaft 1001 and driven shaft 2001 which must be rotationally connected together (FIGS. 1 and 3) or disengaged (FIG. 2) depending on the operational requirements described below.

The connection between the two said shafts 1001 and 2001 is performed by means of a coupling according to the invention, which comprises a toothed wheel 21 integral with the shaft 2001 of the weave machine 2000 and an electromagnetic operating group 10 surrounding the shaft 1001 of the weaving loom 1000.

The toothed wheel 21 has a set of radial teeth 21*a* and a set of front teeth 21*b* which are designed to engage with a corresponding set of front teeth 11*b* of a disc 11 affixed to the shaft 1001.

This disc is rigidly connected to a resilient ring 12 which in turn is fixed to the shaft 1001 by means of screws 12*a* or the like. The ring 12, which is resilient in the axial direction, but rigid in the radial and circumferential direction, is able to transmit to the disc 11 the torque generated by the rotation of the shaft 1001 and at the same time allow displacement of the disc 11 in the axial direction as a result of the thrusting action of springs 13 housed in associated seats 14*a* of a spring holder 14 keyed onto the shaft 1001.

Figure 1:
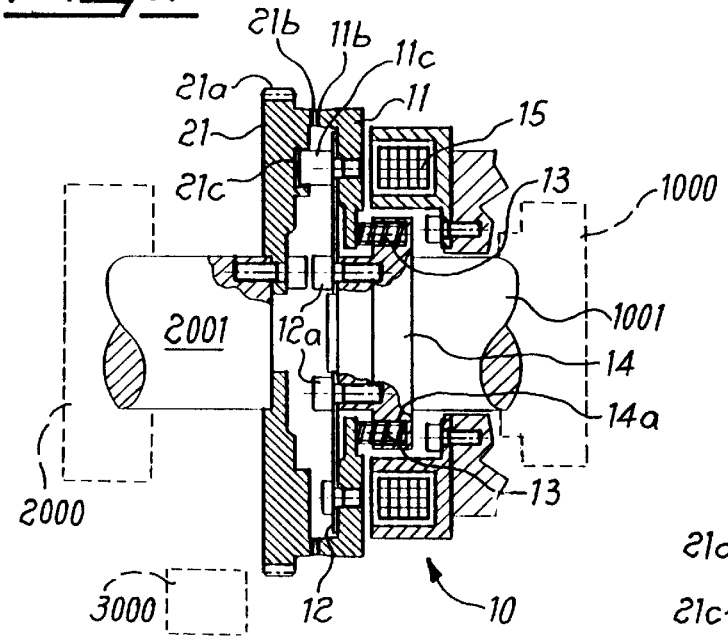
FIG. 1 is a cross-section along a longitudinal plane of the coupling according to the invention in the condition where it is engaged with the shaft of the weave machine of the weaving loom for normal operation.

The clutch group 10 comprises moreover an actuating element for drawing, in the axial direction, the disc 11 which, in the example according to FIG. 1, consists of a fixed annular electromagnet 15 which is integral with a fixed support part and the magnetic field of which acts by attracting the clutch disc 11 towards the shaft 1001. As can been seen, the attraction by the electromagnet occurs against the thrusting action of the springs 13 arranged between the shaft 1001 and the disc 11. Thus, when the electromagnet 15 is excited, it keeps the front teeth 21*b* and 11*b* of the wheel 21 and the disc 11, respectively, disergaged, thereby allowing separate rotation of the shafts 1001 and 2001.

The ring 11 also has, mounted on it, pins 11*c* arranged in non-symmetrical positions and designed to engage in corresponding holes 21*c* of the wheel 21 into which they are inserted, when the respective sets of front teeth 11*b* and 21*b* are engaged, thus ensuring a single connected position of angular coupling between the shaft 1001 and the shaft 2001.

Advantageously the positions of the pins 11*c* and the corresponding holes 21*c* are non-symmetrical so as to allow relative engagement between wheel 21 and ring 11, with insertion of the pins 11*c* into the holes 21*c*, in the single relative angular position, whereas in any other position the dowels rest on the surface of the disc, so as to keep the latter constantly perpendicular to the axis of the shafts 1001 and 2001.

A similar result may be obtained by using sets of front teeth with asymmetrical teeth 3150*b*, 3003*b*, as illustrated in FIG. 6.

As is evident from that described above, the electromagnetic clutch 10 in the de-energized condition allows rotational connection of the shaft 1001 of the loom to the dobby shaft 2001 whereas, when energized, it must disengage the rotation of one from the other. In this way the synchronized coupling between the loom and the dobby is maintained, even when there is no power. As schematically shown in the FIGS., the ring 21 of the dobby shaft 2001 may also be operated by an auxiliary component 3000, for example a motor with a low number of revs, connected to a pinion 3001 with its axis parallel to the axis of the dobby shaft and movable axially in said direction, for engagement with/disengagement from the corresponding radial teeth 21*a* of the wheel 21. The coupling according to the invention operates in the following manner:

in normal operating conditions for weaving (FIG. 1), the electromagnet 15 is de-energized and the auxiliary component 3000 disengaged from the toothed wheel 21 and the springs 13 therefore axially push the disc 11 so as to engage the associated front teeth 11*b* with the corresponding front teeth 21*b* of the wheel 21. As a result the shafts 1001 and 2001 are rotationally connected together, thus causing the synchronized operation of the loom and the dobby;

in the event of breakage of the weft yarn (FIG. 2), the loom 1000 is stopped and the dobby shaft 2001 is disengaged from the loom shaft 1001, by means of energization of the electromagnet 15 which, overcoming the action of the springs 13, pulls the disc 11 away from the wheel 21, disconnecting the shaft 2001 from the shaft 1001. By operating the actuator component 3000, the pinion 3001 meshes with the toothed wheel 21 and the drive shaft 2001 of the dobby 2000 is made to run slowly;

in order to resume normal weaving operation, the shafts 1001 and 2001 must be brought back into the angular configuration corresponding to the stroke prior to stoppage. For this purpose the electromagnet 15 is de-energized so that (FIG. 3) the springs 13 push the disc 11, which is still rotationally immobile, against the wheel 21, causing the pins 11*c* to make light contact with the associated front surface of the wheel itself until they are located opposite the corresponding holes 21*c* and penetrate into them, causing the clutch to close and locking together again the shafts 1001 and 2001 in the correct relative angular position; at the same time as the closing movement of the clutch 2000, the actuator component 3000 is deactivated, thus leaving the loom 1000 and the dobby 2000 coupled together so that weaving may be resumed.

It is therefore obvious how the clutch for weaving machines according to the invention enables all the functions of conventional clutches to be achieved, but with a simplified configuration which allows all the dimensions, the weight and the overall costs of the clutch to be reduced.

In addition, the elimination of the rotor also makes it possible to overcome the problems associated with the peripheral speeds of the rotor itself, which represented a constraint in the design of conventional clutches.

Figure 4A:
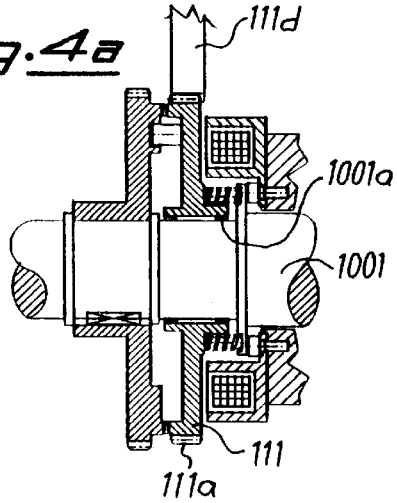
FIG. 4*a* shows a first variation of the clutch according to the invention.
Figure 4B:
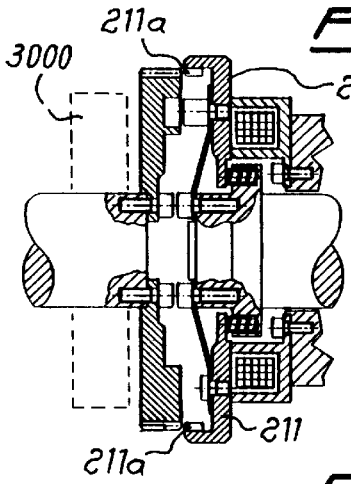
FIG. 4*b* shows a second variation of the clutch according to the invention.
Figure 4C:
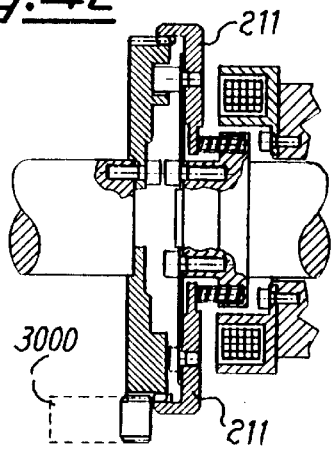
FIG. 4*c* shows a third variation of the clutch according to the invention.

The invention also envisages some variations of embodiment of the component parts of the coupling, as for example illustrated in FIGS. 4*a*, 4*b*, 4*c* which show:

A coupling (FIG. 4*a*) in which the disc 111 of the electromagnetic clutch has radial teeth 111*a* for engagement with a transmission 111*d* which receives movement from the main motor of the weaving loom 1000. In this configuration the shaft 1001 is integral with the dobby shaft and the disc 111 is mounted on the shaft 1001 with the intervening arrangement of bushes 1001*a* and is therefore idle with respect to the shaft itself.

A coupling (FIG. 4*b*) in which the disc 211 has a set of radial teeth 211*a* designed for axial engagement with a corresponding set of radial teeth 21*a* of the toothed wheel 21. This configuration allows the thrusting force of the springs 13 and hence the dimensions of the electromagnet 15 to be reduced since the radial connection does not generate any repulsive forces in the axial direction.

The configuration according to FIG. 4*b* also schematically shows an actuator component 3000 for slow running of the dobby shaft, which is arranged coaxially with the latter. Since the actuator component is of the known type it is not described in detail.

A coupling (FIG. 4*c*) equivalent to that of FIG. 4*b*, but with an actuator element for slow running of the dobby, which is parallel, and not coaxial, with the dobby shaft itself.

Figure 5A:
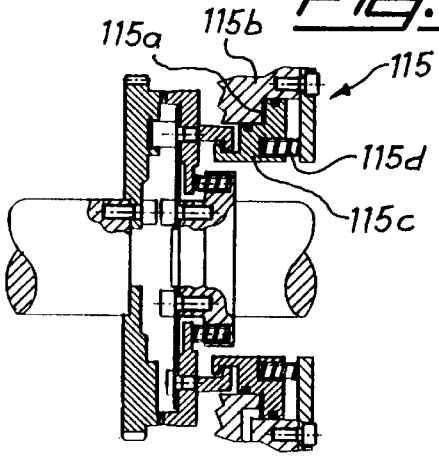
FIGS. 5*a*, 5*b*, 5*c* show a cross-section along a longitudinal plane of the clutch according to the invention with an actuator of the hydraulic type for operation thereof, respectively for normal running, slow running of only the shaft of the weave machine, and slow running of both the shafts.
Figure 5B:
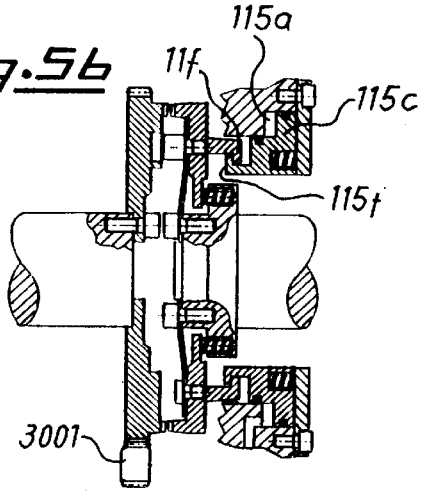
Figure 5C:
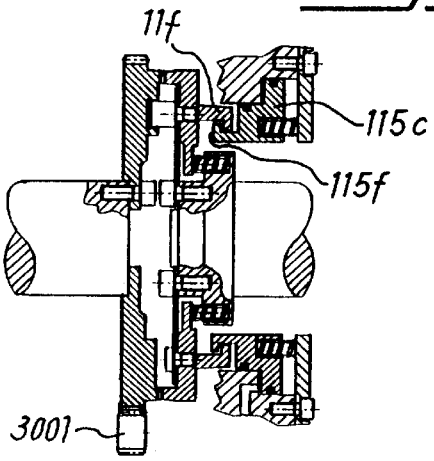

Finally, FIGS. 5*a*,5*b*,5*c* show a coupling according to the invention with a component for causing the translatory movement of the disc 11, consisting of a hydraulic device 115 instead of an electromagnet.

As illustrated, the hydraulic device 115 comprises a chamber 115*a* formed between a fixed cylinder 115*b* and a movable piston 115*c* which is kept pressed forwards towards the disc 11 by the action of axial springs 115*d*.

During normal running conditions (FIG. 5*a*) the chamber 115*a* is discharged and the springs 115*d* push the piston 115*c* so that the latter does not interfere with the disc 11 which is in turn pushed so as to engage with the toothed wheel 21 by the thrust of the springs 13. In this Inteference between the rotating disc 11 and the immobile piston 115*c* is avoided.

In the event of interruption of the weaving process and recovery of the yarn, fluid is supplied to the chamber 115*a*, causing the translatory movement of the piston 115*c* against the action of the springs 115*d*. This translatory movement causes the engagement of two locating surfaces 11*f* and 115*f* of the disc 11 and the piston 115*c*, respectively, with consequent recalling of the disc 11 which is disengaged from the toothed wheel 21, allowing operation of only the dobby shaft by means of the actuator component 3000/3001.

In the case of slow running of both the loom shaft 1001 and the dobby shaft 2001 it is possible, finally, to restore the configuration of FIG. 5*a*, by activating, however, the actuator component 3000 which in this case causes the slow-running rotation of both the shafts. In a further version the device 115 could also be of the pneumatic type instead of the hydraulic type. It is envisaged moreover that the clutch actuating motor may be of the hydraulic and/or pneumatic type.

We claim:

1. A coupling for a loom comprising:

a support;

a loom shaft rotatable relative to said support and having a shaft end projecting beyond said support;

a machine shaft aligned with and spaced from said loom shaft;

a toothed wheel mounted on said machine shaft and formed with an annular array of teeth;

an annular electromagnet on said support surrounding said end of said loom shaft;

a plurality of axially effective springs on said end of said loom shaft; and an axially shiftable magnetically attractable disk mounted on said end of said loom shaft for rotatable entrainment thereby and having a surface directly juxtaposed with said annular electromagnet and engageable therewith on attraction of said disk to said electromagnet upon energization thereof, said disk having an annular array of teeth engageable with the teeth of the toothed wheel, said springs bearing directly against said disk and urging the teeth of said disk into engagement with the teeth of said wheel upon deenergization of said electromagnet.

2. The coupling defined in claim 1 wherein said wheel has a peripheral array of radial teeth and an array of front teeth on a face of said wheel juxtaposed with a face of said disk formed with the array of teeth on said disk.

3. The coupling defined in claim 2 wherein said disk is affixed to a resilient ring coaxially attached to said loom shaft and resilient in an axial direction but rigid in radial and circumferential directions.

4. The coupling defined in claim 2 further comprising a motor having a pinion meshing with said peripheral array of teeth.

5. The coupling defined in claim 2 further comprising a motor coupled with said machine shaft.

6. The coupling defined in claim 2 further comprising pins on said disk engageable in recesses in said wheel located to enable engagement of said disk with said wheel in only one relative angular position of the disk and the wheel.

* * * * *